United States Patent [19]

Young et al.

[11] 4,212,759

[45] Jul. 15, 1980

[54] ACIDIC HYDROCARBON-IN-WATER EMULSIONS

[76] Inventors: David W. Young, 2302 John Hancock Center, 875 N. Michigan Ave., Chicago, Ill. 60611; Donald G. Cherry, c/o Elco Chemicals, Inc., 2454 Palmer Ave., Park Forest, South, Ill. 60466

[21] Appl. No.: 5,607

[22] Filed: Jan. 22, 1979

Related U.S. Application Data

[63] Continuation of Ser. No. 895,626, Apr. 12, 1978, abandoned, which is a continuation of Ser. No. 781,478, Mar. 25, 1977, abandoned, which is a continuation-in-part of Ser. No. 608,639, Aug. 28, 1975, abandoned.

[51] Int. Cl.[2] ..... C11D 7/20; C11D 7/08

[52] U.S. Cl. ..... 252/119; 252/144; 252/312; 252/351; 252/352; 252/DIG. 10

[58] Field of Search ..... 252/142, 143, 144, 145, 252/111, 112, 113, 118, 119, 351, 352, 312, DIG. 10, 8.55 C; 134/3, 41

[56] References Cited

U.S. PATENT DOCUMENTS

| | | | |
|---|---|---|---|
| 2,261,700 | 11/1941 | Ryznar | 252/143 |
| 3,271,319 | 9/1966 | Morrison | 252/142 |
| 3,325,415 | 6/1967 | Kenney et al. | 252/136 X |
| 3,681,122 | 8/1972 | Domicone et al. | 106/2 X |
| 3,794,523 | 2/1974 | Thompson | 252/143 X |
| 3,799,266 | 3/1974 | Kiel | 252/8.55 C X |
| 3,806,460 | 4/1974 | Mukai et al. | 252/DIG. 10 X |
| 3,997,460 | 12/1976 | Sirine et al. | 252/142 X |
| 4,010,105 | 3/1977 | Holgado | 252/312 X |

OTHER PUBLICATIONS

Weiser, *A Textbook of Colloid Chemistry,* 2nd Ed., 1949, p. 344.

*Primary Examiner*—Harris A. Pitlick
*Attorney, Agent, or Firm*—Bernard & Brown

[57] ABSTRACT

An acidic cleaning composition which is especially useful in cleaning glass-ceramic range surfaces comprises an acid-stable, hydrocarbon-in-water emulsion. The composition contains liquid hydrocarbon, solid, porous absorbent, and a minor amount of an acid to provide an acidic emulsion. The composition may also contain a soap or detergent, a minor amount of polysilicone or a thickening agent.

18 Claims, No Drawings

ACIDIC HYDROCARBON-IN-WATER EMULSIONS

This is a continuation of application Ser. No. 895,626, filed Apr. 12, 1978, which in turn is a continuation of application Ser. No. 781,478, filed Mar. 25, 1977, which in turn is a continuation of application Ser. No. 608,639, filed Aug. 28, 1975, all abandoned.

This invention relates to acid-stable, hydrocarbon solvent-in-water emulsions, and more particularly, to cleaning compositions especially useful for cleaning glass or ceramic surfaces including glass-ceramic surfaces such as glass-ceramic range tops, cookware, and the like.

By this invention there is provided an acidic emulsion containing liquid hydrocarbon and water which emulsion does not readily separate on standing. Acidic emulsions may advantageously be employed in cleaning compositions since the low pH assists in cleaning. A cleaning composition may be formulated which comprises the emulsion, and, additionally, solid absorbents, abrasives, soaps, and the like. A surface-treating agent such as polysilicones may be incorporated in the composition to provide a smooth-feeling surface and protect the surface from soiling. The cleaning composition may advantageously be employed to remove oil, grease, carbonized material, food stains, metal marks, and the like from glass-ceramic surfaces.

Glass-ceramics which can withstand substantial thermal shock and have resistance to mechanical shock have been the subject of much development in recent years. One of the many applications for glass-ceramics has been for range tops. These glass-ceramic tops provide an aesthetically pleasing appearance, and the maintenance of the excellent physical appearance of the range tops is of particular importance, especially in the home where the range top may be in constant visual display.

Many difficulties exist in providing acceptable cleaning compositions for glass-ceramic range tops. A cleaning composition should be able to remove from the range top the wide variety of substances which may occur thereon including grease, dust, vegetable stains, materials which are burned, or carbonized, on the surface, and the like, without the expenditure of excessive labor on the part of the person doing the cleaning. Also, in view of the high degree of hardness of glass-ceramics, a cleaning composition should be capable of removing metal marks caused by abrasion of metal from, for instance, cooking ware and utensils, by the glass-ceramic surface. A cleaning composition for range tops should not be deleterious to the glass-ceramic. For example, if the cleaning composition is unduly abrasive, damage may occur to surface, potentially weakening the glass-ceramic structure and providing a poor physical appearance. Scratches on the range surface may also collect debris and increase the difficulty of subsequent cleanings. A cleaning composition should be relatively free from deleterious metal ions such as the alkali and alkaline earth metals which may react with the glass-ceramic surface, especially at high temperatures, to cause an ion exchange with metal ions within the glass-ceramic matrix. Such an ion exchange may weaken the glass-ceramic and result in the formation of microcracks on the surface.

Convenience to the user and simplicity of use are other qualities which are desired in a cleaning composition. For instance, a cleaning composition for glass-ceramic range tops should be effective at room temperature and not require heating in order to provide efficient cleaning activity. The necessity for preparing the surface for cleaning is undesirable due to the complexity and time expenditure which would be added to the cleaning procedure. Similarly, a surface treated with a cleaning composition should not require any post-cleaning treatment, and the residue from the cleaning composition should be able to be quickly and easily removed from the surface. A cleaning composition, however, should not adversely affect the glass-ceramic range surface if left on the surface and subjected to the heat of the range, and any residue should be capable of being easily removed despite having been subjected to the heat of the range.

Acidic cleaning compositions for cleaning glass-ceramics have been proposed. See, for instance, U.S. Pat. No. 3,666,559 in which an aqueous gluconic acid solution is employed for cleaning glass-ceramic tableware and cookware. Acidic cleaning compositions should not provide an undue risk to the user during application, even if protective clothing such as impervious gloves is not worn. The cleaning composition, however, should desirably provide sufficient acidity to facilitate cleaning.

Due to the diversity of substances which must be removed from glass-ceramic range surfaces, agents in cleaning compositions for removing hydrophilic and hydrophobic substances should be employed to provide an effective cleaning composition. Cleaning compositions containing hydrocarbon solvent and water have been suggested for cleaning oil, grease, and the like from surfaces. See, for instance, U.S. Pat. Nos. 2,261,700 to Ryzar and 3,806,460 to Mukai, et al. A concern, however, especially when the cleaning composition may be employed in the home, is minimizing toxicity risks. Cleaning formulations which contain petroleum distillates may require governmental registration and require special handling procedures. Accidental ingestion, for instance, of petroleum distillate may involve not only toxicity by absorption to the body through the digestive tract, but also through inhalation of fumes, particularly if vomiting results. The toxicity risk of petroleum distillates may be significantly reduced where the petroleum distillate is in an emulsion with water from which petroleum distillate does not separate on standing. Emulsions which contain petroleum distillate and water are generally unstable when acidified.

In accordance with this invention, an acid-stable emulsion is provided which comprises liquid hydrocarbon, water, solid, porous absorbent containing silica, said absorbent being provided in an amount at least sufficient to stabilize the emulsion, and a minor amount of an acid, preferably a moderately strong organic or inorganic acid having an ionization constant in water at 25° C. of more than about $1\times10^{-4}$, preferably more than about $1\times10^{-3}$, and frequently less than about $5\times10^{-1}$, say in the range of about $1\times10^{-1}$ to $1\times10^{-3}$, e.g. oxalic acid, sulfamic acid, to provide an acidic composition. The composition preferably has a pH in the range of about 0.5 to 3.5, especially about 1 to 3. Acids with a lower ionization constant than about $1\times10^{-4}$ may be employed; however, larger amounts may be required to provide an acidic composition with a desired pH. The composition may also contain a thickening agent such as sodium carboxymethylcellulose, and the like. The composition may contain a soap or detergent having an essential absence of alkali metal to enhance the cleaning activity of a composition of this invention. The soap or detergent may also assist in maintaining the integrity of the hydrocarbon-in-water emulsion. The soap or detergent may be employed in a minor amount sufficient to enhance the cleaning properties of the composition. The alkanolamine soaps are preferred agents, and they may be prepared in situ during the formulation of the composition by the addition of an organic carboxylic acid and an alkanolamine. The organic carboxylic acid is preferably a monocarboxylic aliphatic acid containing about 10 to 24 or more carbon atoms, and the alkanolamine is preferably a secondary or tertiary alkanol amine. The solid, finely divided absorbent may serve as an abrasive; however, additional finely divided abrasive may be employed. A minor amount of polysilicone, preferably a straight-chain polysilicone, i.e., essentially non-crosslinking polysilicone, may advantageously be employed in the cleaning compositions, especially for cleaning surfaces of glass, porcelain, glass-ceramic, and the like, to provide a smooth-feeling surface which resists soiling.

The hydrocarbon component of the compositions of this invention is desirably liquid at room temperature and preferably boils primarily in the range of about 40° C. to about 350° C. or more. Preferably, the hydrocarbon is one that does not provide an undue fire risk. In a cleaning composition, the liquid hydrocarbon should be sufficiently high boiling such that an excessive amount of the hydrocarbon does not evaporate before completion of the cleaning operation. On the other hand, a hydrocarbon with too high a boiling point may leave an undesirable, oil film on the surface. It has been found that by employing a hydrocarbon composite, or a hydrocarbon fraction, which boils over a range of at least about 50° C. units, preferably in the range of about 70° to 200° C. or more, the cleaning composition exhibits good cleaning properties for an adequate period of time. The hydrocarbon may advantageously be a petroleum distillate, for example, naphtha, kerosene, VM&P naphtha, mineral spirits, and the like, or petroleum solvents such as Stoddard solvent, and the like. Often, the liquid hydrocarbon is a naphtha fraction having primarily an aliphatic structure. A hydrocarbon composite comprising VM&P naphtha and kerosene in a weight ratio of naphtha to kerosene of about 20:1 to 1:1, preferably about 15:1 to 3:1, has been found to be advantageous for use in compositions for cleaning glass-ceramic range tops. The amount of hydrocarbon employed may vary widely; however, generally the weight ratio of water to hydrocarbon in the emulsions of this invention is greater than about 2:1, thus water may be considered as the continuous phase. The water to hydrocarbon weight ratio is often less than about 15:1, and preferably is about 14:1 to 3:1. The hydrocarbon should be provided in an amount sufficient to enhance the cleaning activity of the composition, and frequently comprises about 3 to 20 weight percent of the composition.

The porous absorbent is present in the compositions of this invention in an amount sufficient to stabilize the emulsion, and the absorbent may enhance the cleaning activity of the composition by acting as an absorbent for organic materials and as an abrasive. The absorbent is essentially insoluble in water and liquid hydrocarbon but should be compatible with water and hydrophilic substances and advantageously serve as an absorbent for water and other polar substances. Exemplary finely divided absorbents are solid, porous absorbents which contain silica such as diatomaceous earth, pumice, kieselguhr, and the like. Preferably, the absorbent has a total surface area of at least about 100 square meters per gram. Generally, the amount of absorbent in the emulsions of this invention is about 1 or 1.5 to 4 times by weight of the amount of hydrocarbon in the composition. Frequently, a cleaning composition of this invention may contain about 15 to 35 weight percent absorbent.

Since the absorbent is a solid at ambient conditions, it must be considered in connection with the abrasive qualities of a cleaning composition. The abrasive effect of the absorbent on the surface being treated can be minimized by selecting soft absorbents with small particle sizes. Softer absorbents such as diatomaceous earth may be obtained in particle sizes of less than about 325 mesh or even less than about 400 mesh, and do not deleteriously affect, for instance, a glass-ceramic surface even after thousands of rubbings.

Other abrasives which may be employed in the emulsions of this invention include feldspar, ground quartz, chalk, and the like, and generally the abrasive, its particle size, and amount of abrasive employed are selected based on the intended surface to be cleaned with the composition. Advantageous abrasives are finely divided solids having a particle size in the range of about 5 or 10 to 200 or more microns in diameter, preferably about 15 to 100 microns in diameter. The abrasive may frequently have a hardness of, say, about 2.5 to 7.5 on the Moh scale. Cleaning compositions for treating glass-ceramic surfaces may contain harder abrasives such as pumice in minor amounts to effect desired abrasion, for instance, about 1 to 15, preferably about 3 to 12, percent by weight of the total composition. Desirably, the harder abrasives have a particle size not exceeding 325 mesh. In instances where the cleaning composition is to be used for treating soft glass surfaces, abrasive materials having a hardness less than about 6 or 6.5 on the Moh scale may be preferred. In any event, the total particulate solids including absorbent and abrasives of the cleaning composition is often in the range of about 10 to 35 percent by weight of the total composition.

Another component in the acid-stable emulsion of this invention is a moderately strong acid which provides the desired acidity to the composition. Preferred acids for cleaning compositions are those which provide minimal toxicity risks and include organic and inorganic acids such as oxalic acid, sulfamic acid and the like. A polycarboxylic acid such as oxalic acid may also serve as a complexing agent to provide a product having a gel-like consistency without the addition of a thickening agent. The amount of moderately strong acid which is employed may vary considerably depending on the strength of the acid employed and the desired acidity of a cleaning composition employing the emulsion. The moderately strong acid, for instance, oxalic acid, may also assist in removing metal marks from a glass-ceramic range surface. Generally, the acid is provided in an amount of about 0.5 to 5 or 7 weight percent, preferably about 1 to 3 weight percent, of the total composition. Sufficient moderately strong acid is often provided such that the total acid content of the composition provides a pH of about 0.5 to 3.5, preferably about 1 or 1.5 to 3. The low pH of the cleaning composition assists in cleaning. Upon dilution of the cleaning composition with water in addition to that provided in the cleaning composition, the acidity of the composition may decrease to, say, a pH of about 5 or 6.

The composition may contain surface-active agents including anionic, cationic and non-ionic agents to supplement the cleaning activity of the composition. Suitable water-soluble, organic, surface-active agents which are not deleterious to the intended surface to be cleaned may be employed. The surface-active agent may be an anionic material, for instance, a soap. The soaps which may be employed in the composition include the well-known salts of aliphatic carboxylic acids and sodium, potassium, lithium, amine, including alkanolamine, and the like. It is generally preferred in applications in which the composition is employed to treat glass-ceramic range surfaces that alkali and alkaline earth metal-containing soaps be avoided since they may adversely affect the surface. The preferred soaps are the alkanolamine soaps. Aliphatic carboxylic acids useful in preparing the soaps are the carboxylic acids, preferably monocarboxylic acids, having about 10 to 24 or more carbon atoms. Illustrative of the carboxylic acids are lauric acid, myristic acid, oleic acid, palmitic acid, linoleic acid, and like saturated and unsaturated fatty acids. Soaps prepared from oleic acid may, for instance, have a lower viscosity than those prepared from stearic acid. If the cleaning composition is employed on surfaces which may come in contact with food, for instance, on glass-ceramic range tops, ceramic cooking ware, and the like, the carboxylic acid should be relatively non-coxic.

The alkanolamine soaps may be formed by the reaction of an alkanolamine and the carboxylic acid. The reaction frequently proceeds at ambient temperatures without a catalyst, and thus, the soap may be formed in situ during formulation of the composition by adding the carboxylic acid and alkanolamine. The alkanolamine soap has been described as a loosely bonded addition product. The alkanolamine soaps may also assist in maintaining the hydrocarbon-in-water emulsion. The alkanolamine reactant is preferably a lower alkanolamine, e.g., wherein the alkanol substituents each contain 1 to about 6 carbon atoms. Alkanolamines commonly employed for making alkanolamine soaps include monoethanolamine, monoisopropanolamine, and triethanolamine. Preferably the alkanolamine is a secondary or tertiary amine such as the dialkanolamines and trialkanolamines. The mole ratio of carboxylic acid to alkanolamine may vary widely, but generally, the mole ratio of carboxylic acid to alkanolamine is about 1:5 to 2:1, and preferably, the alkanolamine is in excess of the amount required for stoichiometric reaction. When preparing the alkanolamine soap in situ during the formation of the composition, the carboxylic acid is frequently provided in an amount of about 0.5 to 10, preferably about 1 to 3, weight percent based on total composition, and the alkanolamine may be provided in the amount of about 0.5 to 8, preferably about 0.7 to 3, weight percent based on total composition. Since the alkanolamine soap may also assist in stabilizing the hydrocarbon-in-water emulsion, the alkanolamine soap advantageously be provided in an amount of at least about 2, preferably about 5 to 30, weight percent based on the weight of the hydrocarbon.

Non-ionic surfactants which may be present in the compositions of this invention include the alkylene oxide condensation products, such as reaction products of ethylene oxide with aliphatic carboxylic acids, aliphatic carboxylic amides, aliphatic alcohols, and aralkyl hydrocarbons, e.g., monocyclic aralkyl, of about 8 to 24 carbon atoms. Illustrative of the alkylene oxide condensation surfactants are ethoxylated alkylphenols such as polyoxyethylene nonylphenol; alkylpolyethoxy ethanols such as are prepared from oleyl alcohol, aluryl alcohol, stearyl alcohol, and the like; glycerol esters of aliphatic acids such as the mono- and di-oleate enters, laurate esters, stearate esters, and the like; polyethylene glycol esters of lauric, oleic, stearic acids, or the like; the anhydrosorbitol esters; polyoxyethylene fatty acid amides of isopropanolamine and ethanolamine with lauric acid, oleic acid, stearic acid, and the like.

Other anionic surfactants which may be in the compositions of this invention include the sulfonates such as alkylbenzene sulfonates, naphthalene sulfonates, petroleum sulfonates, and the like; the sulfates such as sulfated alcohols such as lauryl alkyl sulfate; the phosphate esters such as di(2-ethylhexyl) phosphate, octyl phosphate, and the like. Cationic surfactants include quaternary ammonium compounds such as N-alkyltrimethylene diamine, stearyl dimethylbenzyl ammonium chloride, N-distearyl dimethyl ammonium chloride, and the like.

Generally, the surface active agent is provided in a minor amount sufficient to enhance the cleaning activity of the composition. Thus, the surface active agent may be provided in an amount of about 0.1 to 10, preferably about 0.5 to 5, percent by weight of the total composition.

The compositions of this invention may also contain a thickening agent to provide a desirable gel-like consistency. A cleaning composition with a gel-like is particularly attractive in that it can easily be applied to horizontal and non-horizontal surfaces, and spills, or the like, because of the viscosity of the composition, are restricted in area and can easily be cleaned up. In preparing the composition, the thickening agent should preferably be added last and while the mixture is under agitation since the viscosity of the resultant emulsion may be such that any subsequent addition of materials to the composition would be of increased difficulty. In the situation wherein a polycarboxylic acid such as oxalic acid which may serve as a complexing agent to thicken the composition is employed as the moderately strong acid, the polycarboxylic acid is preferably added last to the composition in conjunction with a thickening agent, if needed. Exemplary of the thickening agents which may be employed in accordance with this invention are sodium carboxymethylcellulose, carboxypolyethylene polymers, and the like. Preferably, the thickening agent is relatively non-toxic. The thickening agent may be provided in an amount sufficient to provide a composition having a desired consistency. Frequently the amount of thickening agent may be in an amount of about 0.2 to 8, preferably about 0.5 to 5, weight percent of the total composition.

The cleaning composition may also contain polysilicones, or organosilicones, i.e., silicones containing carbon, hydrogen, silicon and oxygen, as a surface-treating agent to give a smooth feel to the surface and help protect the surface from soiling due to dirt, spills, and the like. The organosilicone is preferably a straight-chained silicone which does not readily cross-link. The silicone may desirably be liquid at room temperature. Suitable polysilicones include the dimethyl siloxane polymers and are preferably fluids at room temperature. The fluid polysilicones may have viscosities at room temperature ranging from about 0.5 to 100,000 or more centistokes. The minor amount of silicone provided in the composition is frequently about 1 to 7 percent, preferably about 2 to 5 percent, by weight of the total composition.

The cleaning composition of this invention may include other ingredients such as perfumes, colorants, and the like.

The invention will be further described by the following examples. All parts and percentages are by weight unless otherwise indicated.

EXAMPLE 1

A cleaning composition is prepared having the following components:

| COMPONENT | PARTS BY WEIGHT |
|---|---|
| Mineral Spirits | 14.35 |
| Kerosene | 1.51 |
| Oleic Acid | 1.88 |
| Oxalic Acid | 1.66 |
| Snow Floss* | 11.20 |
| Celite #319** | 3.85 |
| Dow Corning Polysilicone 922*** | 3.20 |
| Pumice (minus 325 mesh) | 11.20 |
| Triethanol amine | 1.13 |
| Dye* | 0.01 |
| Perfume | 0.01 |
| Water | to make 100 parts |

*Snow Floss is a hydrated silica product available from the Johns Manville Company.
**Celite #319 is a diatomaceous earth having a particle size of minus 325 mesh.
***Dow Corning Polysilicone 922 is a straight-chain, non-cross linking dimethoxy siloxane polymer available from Dow Corning Corporation.

The composition is prepared by sequentially admixing the mineral spirits, kerosene, oleic acid, polysilicone, water and triethanolamine. The mixture is maintained under constant stirring and the Snow Floss, Celite #319, and pumice are gradually added to avoid lumping or uneven mixing. The dye and perfume are added while still maintaining stirring of the mixture. Finally, oxalic acid is added and within about one to two minutes, the mixture gels and the stirring is stopped.

The composition is semi-liquid and can be poured, but is not excessively runny. It has a pH of about 2. On standing for one month, a small amount of a clear liquid layer appears at the top of the composition and is analyzed to be aqueous in nature. Agitation of the composition quickly restores the original, uniform product. Freezing the composition followed by thawing does not alter the stability of the gel.

EXAMPLE 2

The procedure of Example 1 is essentially repeated except that 11.20 parts of Celite #319 and 3.85 parts of pumice (minus 325 mesh) are employed.

EXAMPLE 3

The composition of Example 1 is tested for its cleaning ability on a glass-ceramic range surface. Approximately 5 grams of oleomargarine are smeared on about an 80 square inch area of the surface, and then heated until a black, carbonized stain appears. The range surface is cooled to about room temperature and the cleaning composition of Example 1 is spread over the stained area and about 10 to 20 strokes over the area with a damp cloth is sufficient to remove the stain. The procedure of this example is essentially repeated except employing tomato paste, creamed baby peas, butter, and vegetable soup. In each case the stain is easily removed employing the cleaning composition of Example 1.

The bottom of an aluminum pan is scuffed on the range surface leaving aluminum metal marks. The cleaning composition of Example 1 is applied using a damp cloth and the marks are removed.

EXAMPLE 4

The procedure of Example 1 is essentially repeated except that the components and amounts are as follow and sodium carboxymethylcellulose is the last added ingredient and is added subsequent to the sulfamic acid:

| COMPONENT | Parts by weight |
|---|---|
| Mineral Spirits | 14.00 |
| Kerosene | 1.00 |
| Oleic Acid | 1.88 |
| Sulfamic Acid | 1.50 |
| Snow Floss | 10.00 |
| Celite #319 | 3.85 |
| Pumice | 10.00 |
| Dow Corning Polysilicone 200FL* | 3.85 |
| Triethanol amine | 1.13 |
| Makon ® 10** | 1.00 |
| Dye | 0.017 |
| Perfume | 0.095 |
| Sodium Carboxymethylcellulose | 1.50 |
| Water | to make 100 parts |

*Dow Corning Polysilicone 200 FL is a liquid, straight chain, non-cross linking dimethoxy siloxane polymer available from Dow Corning Corporation.
**Makon ® 10 is a nonylphenol ethoxylate being a condensation product of about 10 moles of ethylene oxide per mole of nonylphenol and is available from Stepan Chemical Co.

The composition of this example exhibits good storage stability and is an excellent cleaning composition for glass-ceramic surfaces.

EXAMPLE 5

The procedure of Example 1 is essentially repeated except that the components and amounts are as follow and sodium carboxymethylcellulose is the last added ingredient and is added subsequent to the sulfamic acid:

| COMPONENT | Parts by weight |
|---|---|
| Mineral Spirits | 14.00 |
| Kerosene | 1.00 |
| Oleic Acid | 1.88 |
| Sulfamic Acid | 2.00 |
| Snow Floss | 7.00 |
| Pumice | 3.00 |
| Celite #319 | 13.00 |
| Dow Corning Polysilicone 200FL | 3.00 |
| Triethanol amine | 1.13 |
| Makon ® 10 | 1.00 |
| Dye | 0.017 |
| Perfume | 0.095 |
| Water | to make 100 parts. |

The composition of this example exhibits good storage stability and is an excellent cleaning composition for glass-ceramic surfaces.

It is claimed:

1. An acidic cleaning composition in the form of a stable hydrocarbon-in-water emulsion for cleaning surfaces comprising about 3 to 20 weight percent liquid hydrocarbon having a boiling range of about 130° C. to 350° C., about 15 to 35 weight percent porous silica absorbent, said absorbent having a surface area of at least about 100 square meters per gram and a particle size in the range of about 10 to 200 microns in diameter; about 0.5 to 7 weight percent moderately strong acid; about 0.5 to 10 weight percent aliphatic monocarboxylic acid having about 10 to 24 carbon atoms; about 0.5 to 5 of secondary or tertiary lower alkanol amine; and water; said composition having a pH of about 1 to 3.

2. The acidic cleaning composition of claim 1 wherein the moderately strong acid is oxalic acid.

3. The acidic cleaning composition of claim 1 wherein the moderately strong acid is sulfamic acid.

4. The acidic cleaning composition of claim 3 wherein the emulsion contains sufficient thickening agent to provide a gel-like consistency to the emulsion.

5. The acidic cleaning composition of claim 4 wherein the thickening agent is sodium carboxymethylcellulose and is in an amount of about 0.5 to 5 weight percent of the composition.

6. The acidic cleaning composition of claim 1 wherein the cleaning composition contains about 1 to 7 weight percent of a straight-chain polysilicone.

7. An acidic, acid-stable, hydrocarbon-in-water emulsion comprising an emulsion-providing combination consisting essentially of a liquid hydrocarbon, water in an amount to provide a weight ratio of water to liquid hydrocarbon greater than about 2:1, a minor amount of a porous absorbent silica sufficient to stabilize the emulsion, and a minor amount of a moderately strong acid sufficient to provide a pH of about 0.5 to 3.5.

8. The emulsion of claim 7 wherein the water to hydrocarbon ratio is about 14:1 to 3:1.

9. The emulsion of claim 7 wherein the amount of absorbent is about 1 to 4 times by weight of the amount of hydrocarbon.

10. The emulsion of claim 7 wherein the moderately strong acid is oxalic acid.

11. The emulsion of claim 7 wherein the moderately strong acid is sulfamic acid.

12. The emulsion of claim 11 wherein the emulsion contains sufficient thickening agent to provide a gel-like consistency to the emulsion.

13. An acidic cleaning composition in the form of a stable hydrocarbon-in-water emulsion for cleaning surfaces consisting essentially of a liquid hydrocarbon; water, wherein the weight ratio of water to liquid hydrocarbon is greater than about 2:1; a minor amount of a porous silica absorbent, said absorbent having a surface area of at least about 100 square meters per gram and a particle size in the range of about 10 to 200 microns in diameter sufficient to stabilize the composition; and a minor amount of a moderately strong acid sufficient to provide a pH of about 0.5 to 3.5, said emulsion further containing a minor amount of an amine soap of an aliphatic carboxylic acid having about 10 to 24 carbon atoms and a secondary or tertiary lower alkanol amine, to enhance the cleaning activity of the composition.

14. The cleaning composition of claim 7 or 13 wherein the cleaning composition contains a minor amount of a straight-chain polysilicone to provide a smooth-feeling surface which resists soiling.

15. The cleaning composition of claim 14 wherein the emulsion contains sufficient thickening agent to provide a gel-like consistency to the emulsion.

16. The cleaning composition of claim 13 wherein the moderately strong acid is oxalic acid.

17. The cleaning composition of claim 13 wherein the moderately strong acid is sulfamic acid.

18. An acidic, acid-stable, hydrocarbon-in-water emulsion comprising about 3 to 20 weight percent liquid hydrocarbon having a boiling range of about 130° C. to 350° C.; about 15 to 35 weight percent porous silica absorbent, said absorbent having a surface area of at least about 100 square meters per gram; a minor amount of a moderately strong acid sufficient to provide a pH of about 0.5 to 3.5; and water in a weight ratio to said liquid hydrocarbon greater than about 2:1.

* * * * *